US008362964B2

(12) United States Patent
Ke et al.

(10) Patent No.: US 8,362,964 B2
(45) Date of Patent: Jan. 29, 2013

(54) METHOD AND AUXILIARY DEVICE FOR ADJUSTING ANTENNA ANGLE

(75) Inventors: Youhe Ke, Shenzhen (CN); Tiesheng Zhang, Shenzhen (CN); Maosheng Huang, Shenzhen (CN); Haifeng Wang, Shenzhen (CN)

(73) Assignee: Huawei Technologies Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 13/463,957

(22) Filed: May 4, 2012

(65) Prior Publication Data

US 2012/0218159 A1 Aug. 30, 2012

Related U.S. Application Data

(63) Continuation of application No. PCT/CN2011/073737, filed on May 6, 2011.

(30) Foreign Application Priority Data

Jul. 31, 2010 (CN) ..... 2010 1 0241597

(51) Int. Cl.
*H01Q 3/00* (2006.01)

(52) U.S. Cl. ..... 343/760; 343/763; 343/765

(58) Field of Classification Search ..... 343/757, 343/760, 765, 763; 342/374, 359
See application file for complete search history.

(56) References Cited

U.S. PATENT DOCUMENTS

| | | | | |
|---|---|---|---|---|
| 3,448,450 | A * | 6/1969 | Alfandari et al. | 342/157 |
| 4,002,827 | A * | 1/1977 | Nevin et al. | 342/185 |
| 6,972,724 | B1 | 12/2005 | Tian et al. | |
| 2003/0038743 | A1 | 2/2003 | Shin | |
| 2005/0275597 | A1 | 12/2005 | Tian et al. | |
| 2008/0297425 | A1 | 12/2008 | Axton et al. | |
| 2010/0182199 | A1 * | 7/2010 | Jeong | 342/374 |
| 2010/0188304 | A1 * | 7/2010 | Clymer et al. | 343/753 |

FOREIGN PATENT DOCUMENTS

| | | | | |
|---|---|---|---|---|
| CN | 2388073 | Y | | 7/2000 |
| CN | 1937803 | A | | 3/2007 |
| CN | 101089764 | A | | 12/2007 |
| CN | 101494318 | A | | 7/2009 |
| CN | 101520325 | A | | 9/2009 |
| CN | 102064386 | A | | 5/2011 |
| JP | 2002016422 | A | * | 1/2002 |
| JP | 2004101300 | A | * | 4/2004 |

OTHER PUBLICATIONS

English language International Search Report from the State Intellectual Property Office of P.R. China for International Application No. PCT/CN2011/073737 mailed Aug. 11, 2011.

* cited by examiner

*Primary Examiner* — Tho G Phan
(74) *Attorney, Agent, or Firm* — Finnegan, Henderson, Farabow, Garrett & Dunner, LLP

(57) ABSTRACT

An auxiliary device for adjusting an antenna angle includes: an inputting unit, configured to input preset angle information of an antenna; a sensing unit, configured to perform sensing and obtain angle information of the antenna; a processing unit, configured to compare the angle information of the antenna with the preset angle information of the antenna according to the angle information of the antenna and the preset angle information of the antenna, and control a prompting unit to send a prompt when the angle information of the antenna is consistent with the preset angle information of the antenna; and the prompting unit, configured to send the prompt.

29 Claims, 14 Drawing Sheets

METHOD AND AUXILIARY DEVICE FOR ADJUSTING ANTENNA ANGLE

CROSS-REFERENCE TO RELATED APPLICATIONS

This application is a continuation of International Application No. PCT/CN2011/073737, filed on May 6, 2011, which claims priority to Chinese Patent Application No. 201010241597.0, filed on Jul. 31, 2010, both of which are hereby incorporated by reference in their entireties.

FIELD OF THE INVENTION

The present invention relates to the field of wireless communication, and in particular, to a method and an auxiliary device for adjusting an antenna angle.

BACKGROUND OF THE INVENTION

A mobile communication system generally uses antennas for receiving and sending signals. To widen the signal coverage, the antennas generally need to be mounted on the top of a tower or even higher. The signal capacity and the coverage of an antenna are limited. To increase the capacity and widen the coverage, thousands of antennas are used to make up an array, and the azimuth and the tilt angle of the antennas are designed to enable the signals to make up a cellular structure.

Outdoor antenna devices require mounting at high positions. For a base station antenna, an antenna support is connected to the antenna on the ground; and then two installation engineers licensed for working at heights install the support and the antenna as a whole onto a pole on the tower, and adjust the direction angle and lock the pole kit. The process of adjusting the direction angle includes the following: an overhead worker on the tower collaborates with a worker who holds a compass on the ground to find the direction angle of the antenna; by perceiving the azimuth visually, the ground worker instructs the overhead worker to adjust the horizontal azimuth by rotating the antenna until the ground worker visually feels that the azimuth coincides with the preset direction. Afterward, the tilt angle of the antenna is adjusted in this way: the overhead worker pushes the antenna, and then uses an inclinometer to check whether the tilt angle coincides with the angle required by the network planning, and the adjustment is completed by multiple attempts.

At the time of adjusting the azimuth of a microwave antenna, the remote end is fixed, and the local end is adjusted. The process of adjusting the local end includes the following: an overhead worker on the tower collaborates with a worker who holds a compass on the ground to find the horizontal azimuth of the antenna; by perceiving the azimuth visually, the ground worker instructs the overhead worker to adjust the horizontal azimuth by rotating the antenna until the ground worker visually feels that the azimuth coincides with the preset direction; afterward, the RSSI (Received Signal Strength Indicator) voltage value of the local end is measured as a basis of judging whether the antenna is in position, and the azimuth needs to be further adjusted if the antenna is not in position. Afterward, the local end is fixed, and the remote end is adjusted. The process of adjusting the remote end is similar to the process of adjusting the local end. The process of adjusting the tilt angle of a microwave antenna is similar to the process of adjusting the tilt angle of a base station antenna.

In the process of implementing the present invention, the inventor finds that the prior art has at least the following disadvantages:

In the process of adjusting the antenna angle, an overhead worker is required to adjust the antenna on the tower, and a ground worker is required to notify the overhead worker whether the antenna is adjusted to the proper angle. Collaboration of two workers is required. The ground worker is far away from the antenna, and may judge the antenna angle erroneously and provide erroneous angle information for the overhead worker. Consequently, the overhead worker adjusts the antenna to an erroneous angle, and readjustment is required later. The antenna is not adjusted properly until several attempts are made, which leads to low efficiency of adjustment.

SUMMARY OF THE INVENTION

An embodiment of the present invention provides an auxiliary device for adjusting an antenna angle. The auxiliary device can improve efficiency of adjusting the antenna angle.

The following embodiments of the present invention are provided:

A method for adjusting an antenna angle includes:

performing sensing and obtaining angle information of an antenna; and according to the angle information of the antenna and preset angle information of the antenna, comparing the angle information of the antenna with the preset angle information of the antenna, and sending a prompt when the angle information of the antenna is consistent with the preset angle information of the antenna.

An auxiliary device for adjusting an antenna angle includes:

an inputting unit, configured to input preset angle information of an antenna;

a sensing unit, configured to perform sensing and obtain angle information of the antenna;

a processing unit, configured to compare the angle information of the antenna with the preset angle information of the antenna according to the angle information of the antenna and the preset angle information of the antenna, and control a prompting unit to send a prompt when the angle information of the antenna is consistent with the preset angle information of the antenna; and the prompting unit, configured to send the prompt.

An antenna system includes an auxiliary device for adjusting an antenna angle, an antenna, and a mount kit for mounting the antenna. The auxiliary device for adjusting an antenna angle includes:

an inputting unit, configured to input preset angle information of the antenna;

a sensing unit, configured to perform sensing and obtain angle information of the antenna.

a processing unit, configured to compare the angle information of the antenna with the preset angle information of the antenna according to the angle information of the antenna and the preset angle information of the antenna, and control a prompting unit to send a prompt when the angle information of the antenna is consistent with the preset angle information of the antenna; and the prompting unit, configured to send the prompt.

An antenna system includes an antenna and an auxiliary device that is set in the antenna and is used for adjusting an antenna angle. The auxiliary device for adjusting an antenna angle includes:

a sensing unit, configured to perform sensing and obtain angle information of the antenna; and a prompting unit, configured to send a prompt when the angle information of the antenna is consistent with preset angle information of the antenna.

A base station system includes a base station, an antenna, and an auxiliary device for adjusting an antenna angle. The auxiliary device for adjusting an antenna angle includes:

a sensing unit, configured to perform sensing and obtain angle information of the antenna; and a prompting unit, configured to send a prompt when the angle information of the antenna is consistent with preset angle information of the antenna;

where the sensing unit and the prompting unit of the auxiliary device for adjusting an antenna angle are set inside the antenna.

As can be seen from the above technical solutions, the embodiments of the present invention bring at least the following benefits:

In the embodiments of the present invention, while the overhead worker on the tower adjusts the antenna, the overhead worker learns, according to the prompt sent when the angle of the antenna is consistent with the preset angle information of the antenna, that the antenna is adjusted into position, and the overhead worker stops operations upon receiving the prompt. In this way, the efficiency of adjusting the antenna angle can be improved.

DETAILED DESCRIPTION OF THE EMBODIMENTS

Embodiments of the present invention provide a method and an auxiliary device for adjusting an antenna angle to improve efficiency of adjusting the antenna angle.

Figure 1:
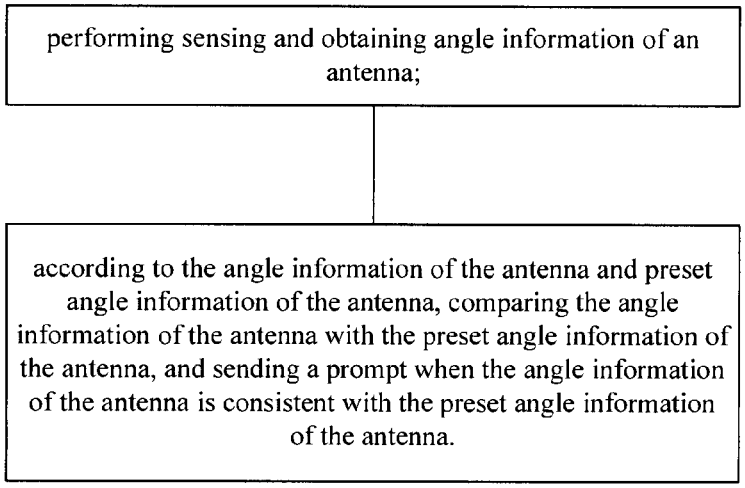
FIG. 1 is a schematic diagram of a method for adjusting an antenna angle according to an embodiment of the present invention.

As shown in FIG. 1, an embodiment of the present invention provides a method for adjusting an antenna angle, including:

performing sensing and obtaining angle information of an antenna; and according to the angle information of the antenna and preset angle information of the antenna, comparing the angle information of the antenna with the preset angle information of the antenna, and sending a prompt when the angle information of the antenna is consistent with the preset angle information of the antenna.

In the embodiment of the present invention, while an overhead worker on a tower adjusts the antenna, the overhead worker learns, according to the prompt sent when the angle of the antenna is consistent with the preset angle information of the antenna, that the antenna is adjusted into suitable position, and the overhead worker stops operations upon receiving the prompt. In this way, efficiency of adjusting the antenna angle can be improved.

In the embodiment of the present invention, the preset angle information of the antenna may include the horizontal azimuth of the antenna, or the tilt angle of the antenna, or both the horizontal azimuth of the antenna and the tilt angle of the antenna.

The angle information of the antenna may include the horizontal azimuth of the antenna, or the tilt angle of the antenna, or both the horizontal azimuth of the antenna and the tilt angle of the antenna.

The prompt may be a sound signal, or a vibration signal, or a light signal, or any combination of a sound signal, vibration signal, and light signal.

The sound signal may be a continuous buzz, or an intermittent buzz, or a preset announcement. The light signal may be emitted light, colorful light, or blinking light.

Figure 2:
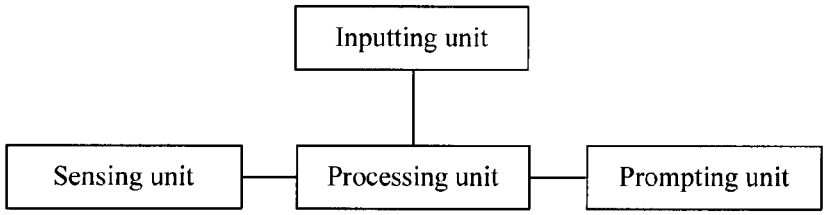
FIG. 2 is a schematic diagram of an auxiliary device for adjusting an antenna angle according to an embodiment of the present invention.

As shown in FIG. 2, an embodiment of the present invention provides an auxiliary device for adjusting an antenna angle, including:

an inputting unit, configured to input preset angle information of an antenna;

a sensing unit, configured to perform sensing and obtain angle information of the antenna;

a processing unit, configured to compare the angle information of the antenna with the preset angle information of the antenna according to the angle information of the antenna and the preset angle information of the antenna, and control a prompting unit to send a prompt when the angle information of the antenna is consistent with the preset angle information of the antenna; and the prompting unit, configured to send the prompt.

In the embodiment of the present invention, an overhead worker on a tower may fix the auxiliary device for adjusting an antenna angle of the antenna, so that the angle information of the antenna sensed by the sensing unit of the auxiliary device is consistent with the angle of the antenna. The angle information of the antenna sensed by the sensing unit may reflect the current angle of the antenna. While the overhead worker on the tower adjusts the antenna, the prompting unit sends prompting information when the angle of the antenna is consistent with the preset angle information of the antenna, where the prompting information indicates that the antenna is adjusted into suitable position. The overhead worker stops operations upon receiving the prompting information, thereby effectively improving the efficiency of adjusting the antenna angle.

Further, the auxiliary device has the function of reminding the overhead worker on the tower whether the antenna is adjusted into position. Therefore, the overhead worker on the tower does not need to have a good sense of direction, and the skill requirement on the overhead worker is reduced.

Further, the auxiliary device can recognize the azimuth and angle of the antenna, and remind the overhead worker whether the antenna is adjusted into position. Therefore, reminding from a ground worker is not required, and labor cost is saved.

Figure 3:
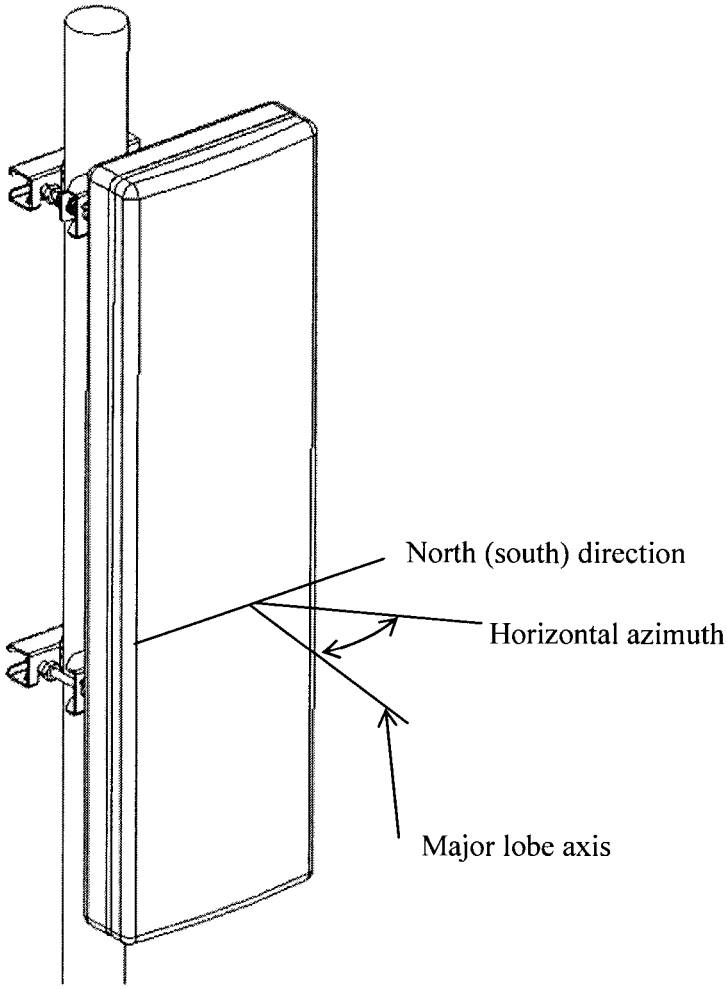
FIG. 3 is a schematic diagram of a horizontal azimuth of a base station antenna.
Figure 4:
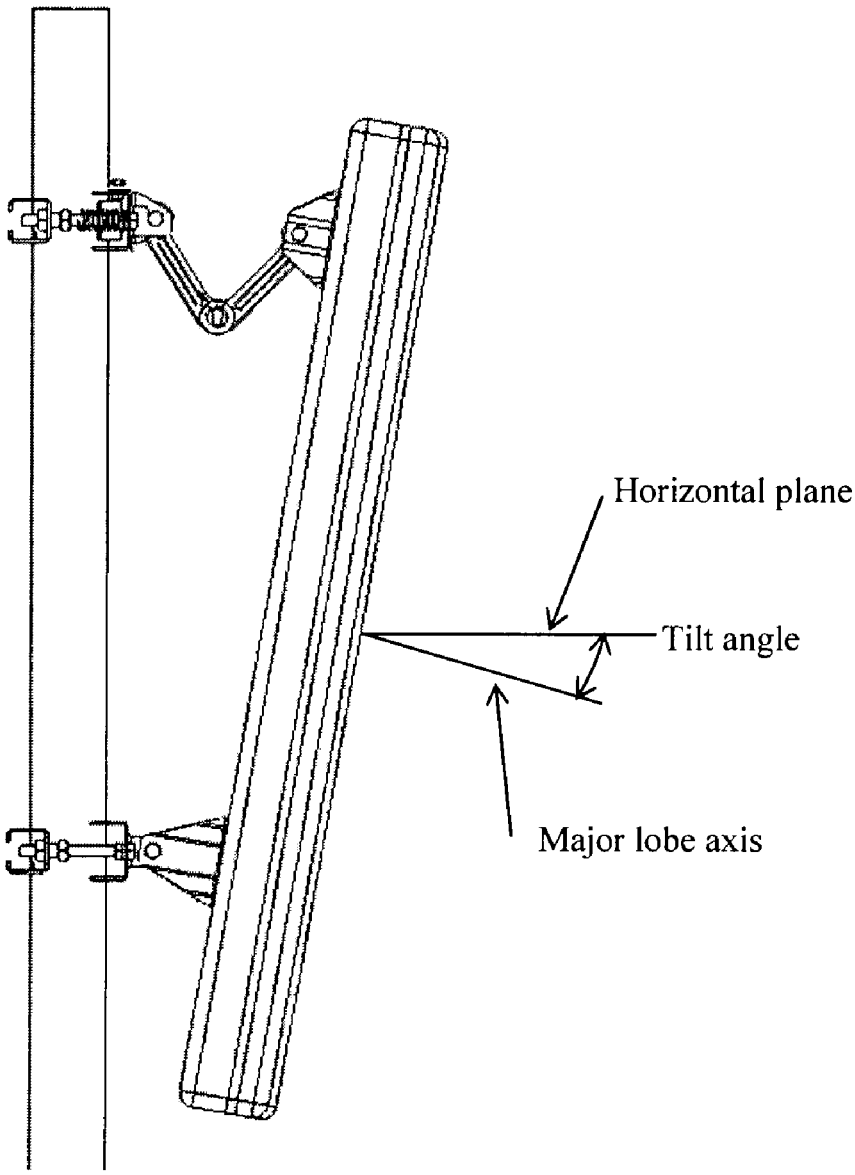
FIG. 4 is a schematic diagram of a tilt angle of a base station antenna.
Figure 5:
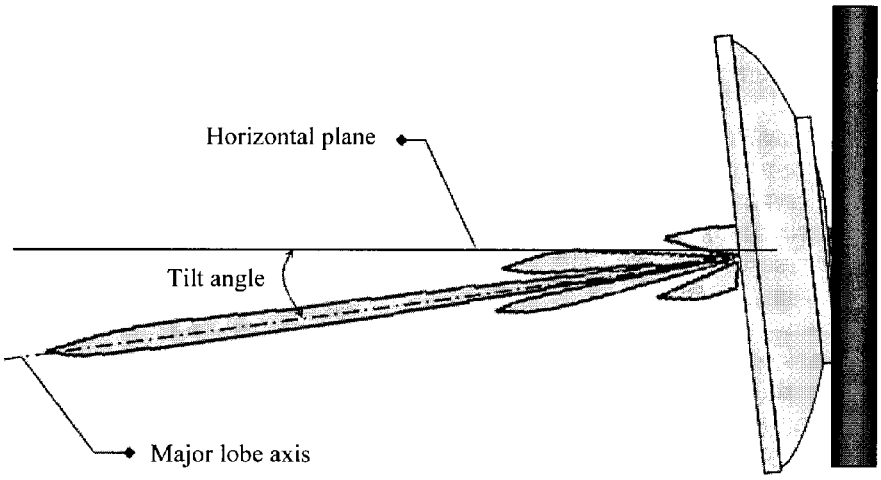
FIG. 5 is a schematic diagram of a horizontal azimuth of a microwave antenna.
Figure 6:
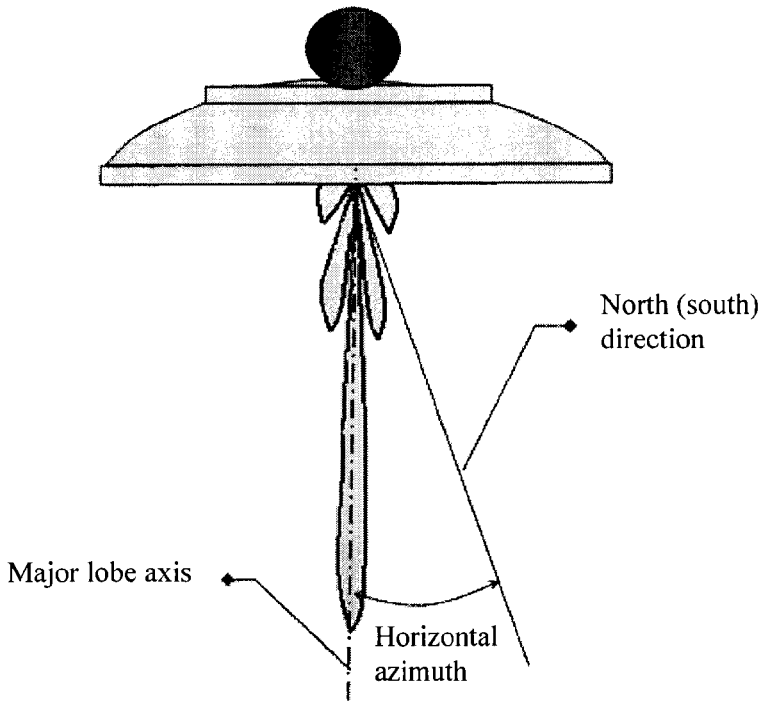
FIG. 6 is a schematic diagram of a tilt angle of a microwave antenna.

The preset angle information of the antenna refers to a desired antenna angle, to which the antenna is adjusted, for getting a better or even best operation state to receive or send signals. In the embodiment of the present invention, the preset angle information of the antenna may include the horizontal azimuth of the antenna, or the tilt angle of the antenna, or both the horizontal azimuth and the tilt angle of the antenna. FIGS. 3 and 4 show the horizontal azimuth and the tilt angle of a base station antenna. An angle between the major lobe axis (or a line parallel to the major lobe axis) of the base station antenna and the north (south) direction in the horizontal azimuth is the horizontal azimuth; and an angle between the major lobe axis (or a line parallel to the major lobe axis) of the base station antenna and the horizontal plane is the tilt angle. FIGS. 5 and 6 show the horizontal azimuth and the tilt angle of a microwave antenna. An angle between the major lobe axis (or a line parallel to the major lobe axis) of the microwave antenna and the north (south) direction in the horizontal azimuth is the horizontal azimuth; and an angle between the major lobe axis (or a line parallel to the major lobe axis) of the microwave antenna and the horizontal plane is the tilt angle.

In the embodiment of the present invention, the angle information of the antenna measured by the auxiliary device is used to represent the current angle of the antenna. Therefore, the angle information of the antenna actually refers to the current angle information of the antenna. The angle information of the antenna may include the horizontal azimuth of the antenna, or the tilt angle of the antenna, or both the horizontal azimuth and the tilt angle of the antenna.

In the angle information of the antenna, the horizontal azimuth of the antenna may be represented as an angle between the major lobe axis (or a line parallel to the major lobe axis) of the antenna and the X axis, an angle between the major lobe axis of the antenna and Y axis, and an angle between the major lobe axis of the antenna and Z axis, or represented as the X-coordinate, Y-coordinate, and Z-coordinate of a point on the major lobe axis (or a line parallel to the major lobe axis) of the antenna; or definitely may be directly expressed as a horizontal azimuth.

Correspondingly, in the preset angle information of the antenna, the horizontal azimuth of the antenna may also be represented as an angle between the major lobe axis (or a line parallel to the major lobe axis) of the antenna and the X axis, an angle between the major lobe axis of the antenna and Y axis, and an angle between the major lobe axis of the antenna and Z axis, or represented as the X-coordinate, Y-coordinate, and Z-coordinate of a point on the major lobe axis (or a line parallel to the major lobe axis) of the antenna; or may be directly expressed as a horizontal azimuth.

In the embodiment of the present invention, if the preset angle information of the antenna includes the horizontal azimuth and tilt angle of the antenna, and the angle information of the antenna includes the horizontal azimuth and tilt angle of the antenna, the comparing the angle information of the antenna with the preset angle information of the antenna includes: comparing the horizontal azimuth of the antenna in the preset angle information of the antenna with the horizontal azimuth of the antenna in the angle information of the antenna; and comparing the tilt angle of the antenna in the preset angle information of the antenna with the tilt angle of the antenna in the angle information of the antenna.

If the preset angle information of the antenna includes the horizontal azimuth of the antenna, and the angle information of the antenna includes the horizontal azimuth of the antenna, the comparing the angle information of the antenna with the preset angle information of the antenna includes: comparing the horizontal azimuth of the antenna in the preset angle information of the antenna with the horizontal azimuth of the antenna in the angle information of the antenna.

If the preset angle information of the antenna includes the tilt angle of the antenna, and the angle information of the antenna includes the tilt angle of the antenna, the comparing the angle information of the antenna with the preset angle information of the antenna includes: comparing the tilt angle of the antenna in the preset angle information of the antenna with the tilt angle of the antenna in the angle information of the antenna.

In the embodiment of the present invention, the prompt sent by the prompting unit may be a sound signal, or a vibration signal, or a light signal, or any combination of a sound signal, vibration signal, and light signal.

The sound signal may be a continuous buzz, or an intermittent buzz, or a preset announcement. The light signal may be emitted light, colorful light, or blinking light.

The prompting unit may be a buzzer.

In the embodiment of the present invention, the sensing unit may include a north-seeking gyro, or a total station, or a dual-GPS (Global Positioning System, global positioning system), or a magnetic flux sensor, or a gravity sensor.

In addition, the sensing unit may also include a magnetic flux sensor and a gravity sensor.

The magnetic flux sensor is configured to sense the geomagnetic field to obtain the horizontal azimuth of the antenna; and the gravity sensor is configured to detect gravity acceleration to obtain the tilt angle of the antenna.

Figure 7:
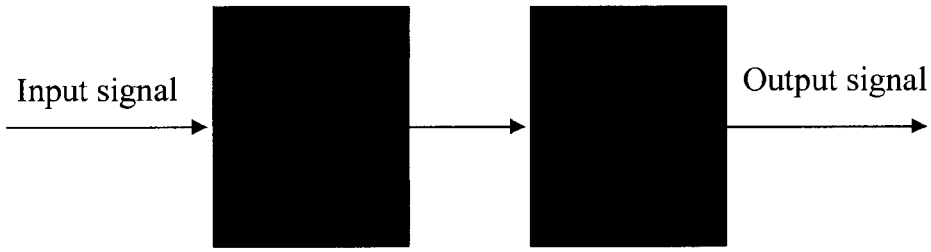
FIG. 7 is a schematic diagram of a filtering and amplifying circuit in an auxiliary device for adjusting an antenna angle according to an embodiment of the present invention.

As shown in FIG. 7, in the embodiment of the present invention, the auxiliary device for adjusting an antenna angle may further include:

a filtering and amplifying circuit, configured to filter and amplify the angle information of an antenna for being further processed by a subsequent circuit.

A sensing unit obtains weak analog signals. The filtering and amplifying circuit filters and amplifies the analog signals to reduce noise interference and improve detection accuracy.

Figure 8:
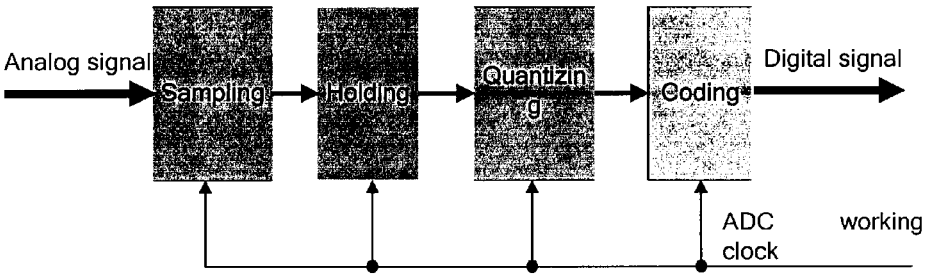
FIG. 8 is a schematic diagram of an AD sampling circuit in an auxiliary device for adjusting an antenna angle according to an embodiment of the present invention.

As shown in FIG. 8, in the embodiment of the present invention, the auxiliary device for adjusting an antenna angle may further include an AD (analog-digital,) sampling circuit.

The AD sampling circuit is configured to perform analog-digital conversion for the angle information of the antenna.

The angle information of the antenna includes analog signals. The AD sampling circuit converts the analog signals into digital signals.

As shown in FIG. 8, the working principles of the AD sampling circuit include: sampling, holding, quantizing, coding, and converting analog signals into digital signals.

The signals processed by the AD sampling circuit (the angle information of the antenna) may be signals processed by the filtering and amplifying circuit, or may be signals that are not processed by the filtering and amplifying circuit. In other words, the auxiliary device for adjusting an antenna angle does not necessarily include a filtering and amplifying circuit when it includes an AD sampling circuit. Further, the auxiliary device for adjusting an antenna angle does not necessarily include an AD sampling circuit when it includes a filtering and amplifying circuit. The auxiliary device for adjusting an antenna angle may include both an AD sampling circuit and a filtering and amplifying circuit.

Figure 9:
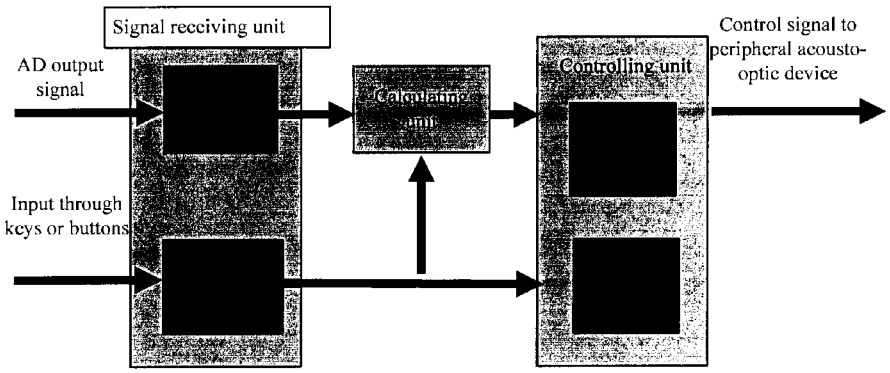
FIG. 9 is a schematic diagram of an MCU processing circuit in an auxiliary device for adjusting an antenna angle according to an embodiment of the present invention.

As shown in FIG. 9, in the embodiment of the present invention, a processing unit may include an MCU (Micro Control Unit, micro controlling unit) processing circuit.

The MCU processing circuit is configured to compare angle information of an antenna and preset angle information of the antenna, and control a prompting unit to send a prompt when the angle information of the antenna is consistent with the preset angle information of the antenna.

"The angle information of the antenna is consistent with the preset angle information of the antenna" means: The horizontal azimuth of the antenna reflected by the angle information of the antenna is consistent with the horizontal azimuth of the antenna reflected by the preset angle information of the antenna; or, the tilt angle of the antenna reflected by the angle information of the antenna is consistent with the tilt angle of the antenna reflected by the preset angle information of the antenna; or, the horizontal azimuth and tilt angle of the antenna that are reflected by the angle information of the antenna are consistent with the horizontal azimuth and tilt angle of the antenna that are reflected by the preset angle information of the antenna.

Even if the representation of angle information of the antenna may be different from that of the preset angle information of the antenna, for example, one is represented as an angle between the major lobe axis (or a line parallel to the major lobe axis) of the antenna and the X axis, an angle between the major lobe axis of the antenna and Y axis, and an angle between the major lobe axis of the antenna and Z axis, and the other is represented as the horizontal azimuth of the antenna, it is appropriate as long as the antenna angles reflected by them are consistent with each other.

As shown in FIG. 9, the MCU processing circuit includes a signal receiving unit, a calculating unit, and a controlling unit.

The signal receiving unit is configured to receive the angle information of the antenna and the preset angle information of the antenna, and perform digital filtering for the angle information of the antenna and the preset angle information of the antenna, where the angle information of the antenna may be digital signals output by the AD sampling unit to the signal receiving unit.

The signal receiving unit is further configured to store the angle information of the antenna and the preset angle information of the antenna into a data buffer.

The calculating unit is configured to calculate a difference between the preset angle information of the antenna and the angle information of the antenna according to the preset angle information of the antenna and the angle information of the antenna, to obtain an angle deviation signal, where the angle deviation signal may indicate whether the angle information of the antenna is consistent with the preset angle information of the antenna.

The controlling unit is configured to control a prompting unit to send a prompt when the angle deviation signal indicates that the angle information of the antenna is consistent with the preset angle information of the antenna.

Figure 10:
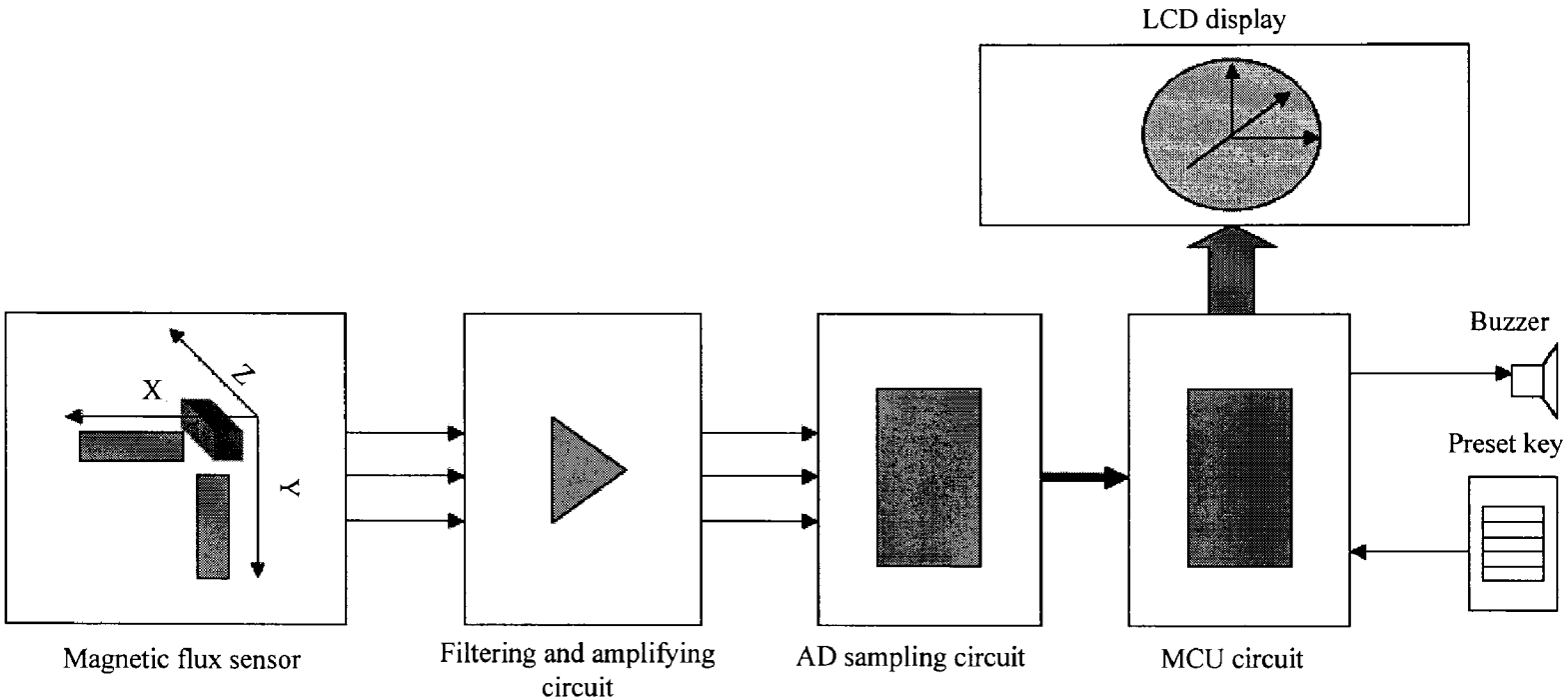
FIG. 10 is a schematic diagram of an auxiliary device for adjusting an antenna angle according to an embodiment of the present invention.
Figure 11:
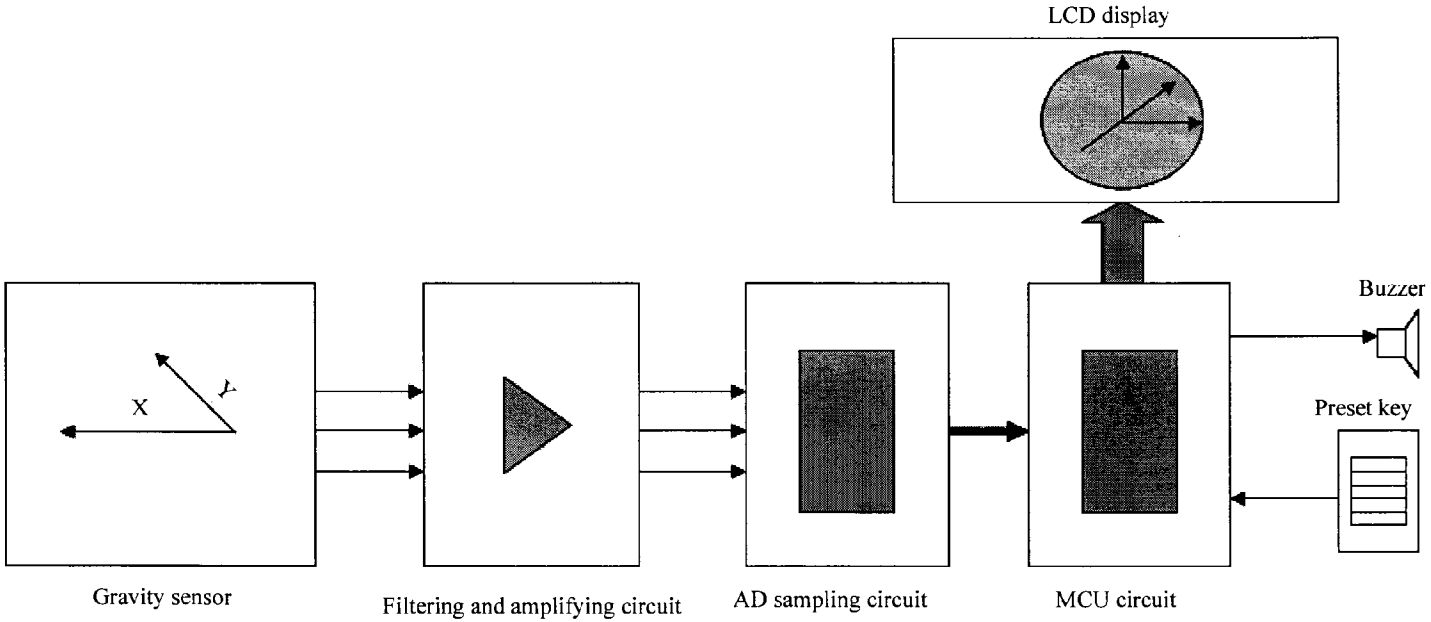
FIG. 11 is a schematic diagram of an auxiliary device for adjusting an antenna angle according to another embodiment of the present invention.
Figure 12:
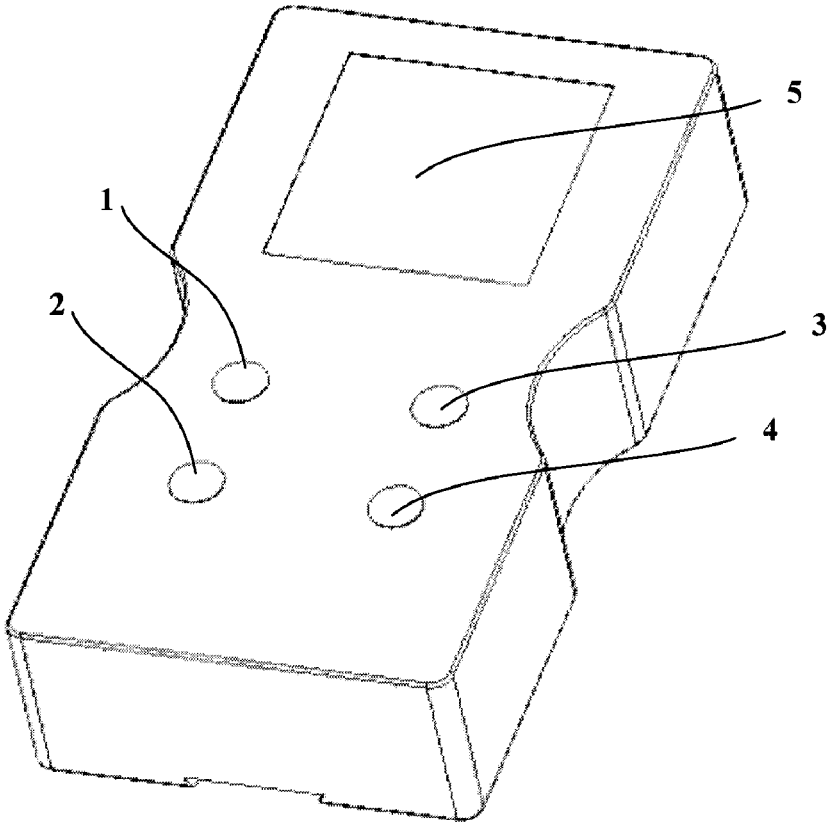
FIG. 12 is a schematic outer appearance diagram of an auxiliary device for adjusting an antenna angle according to an embodiment of the present invention.

FIG. 10 and FIG. 11 each show an auxiliary device for adjusting an antenna angle. As shown in FIG. 12, an inputting unit may be a keypad, and according to the keypad operation of a user, the signal receiving unit of the MCU processing circuit obtains the antenna angle information preset by the user.

Further, the auxiliary device for adjusting an antenna angle may further include a display device, such as an LCD (Liquid Crystal Display, liquid crystal display). The controlling unit of the MCU processing circuit may be further configured to control the display device, such as an LCD, to display the antenna angle information preset by the user.

As shown in FIG. 12, four keys of the auxiliary device may be used for adjusting an antenna angle. As shown in FIG. 12, reference numbers 1, 2, 3, and 4 represent the four keys, where keys 1, 2, and 3 are for inputting the horizontal azimuth, tilt angle, and geomagnetic declination, respectively; and the key 4 is a calibration key. It is noted that: key 3 (for inputting the geomagnetic declination) is an optional key, and is not required if a sensing unit does not sense the geomagnetic field. Reference number 5 represents a display screen.

The auxiliary device for adjusting an antenna angle shown in FIG. 12 is an integrated instrument for measuring the horizontal azimuth and tilt angle. For ease of use, the auxiliary device for adjusting an antenna angle may also be set as two instruments: an auxiliary device for measuring the horizontal azimuth independently, and an auxiliary device for measuring the tilt angle independently.

The present invention further provides an antenna system. The antenna system includes the auxiliary device for adjusting an antenna angle, which is described in the preceding embodiments, and an antenna and a mount kit, where the mount kit is configured to mount the antenna (for example, mounting the antenna onto a pole).

Figure 14:
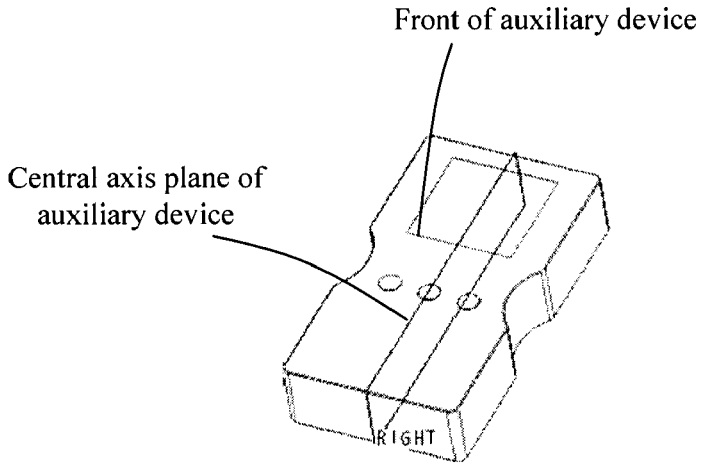
FIG. 14 is a schematic outer appearance diagram of an auxiliary device for adjusting an antenna angle according to an embodiment of the present invention.
Figure 15:
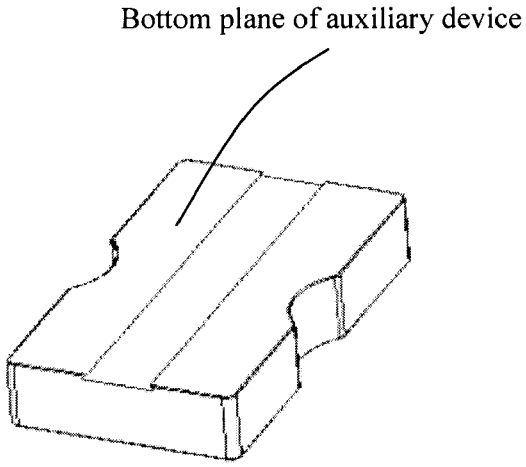
FIG. 15 is a schematic outer appearance diagram of another perspective of an auxiliary device for adjusting an antenna angle according to an embodiment of the present invention.

As shown in FIG. 14 and FIG. 15, the auxiliary device for adjusting an antenna angle, which is described in the preceding embodiments (hereinafter briefly referred to as "auxiliary device"), may further include a casing. The casing may be in a box shape, and one of the outer surfaces of the casing is a bottom plane.

Figure 13:
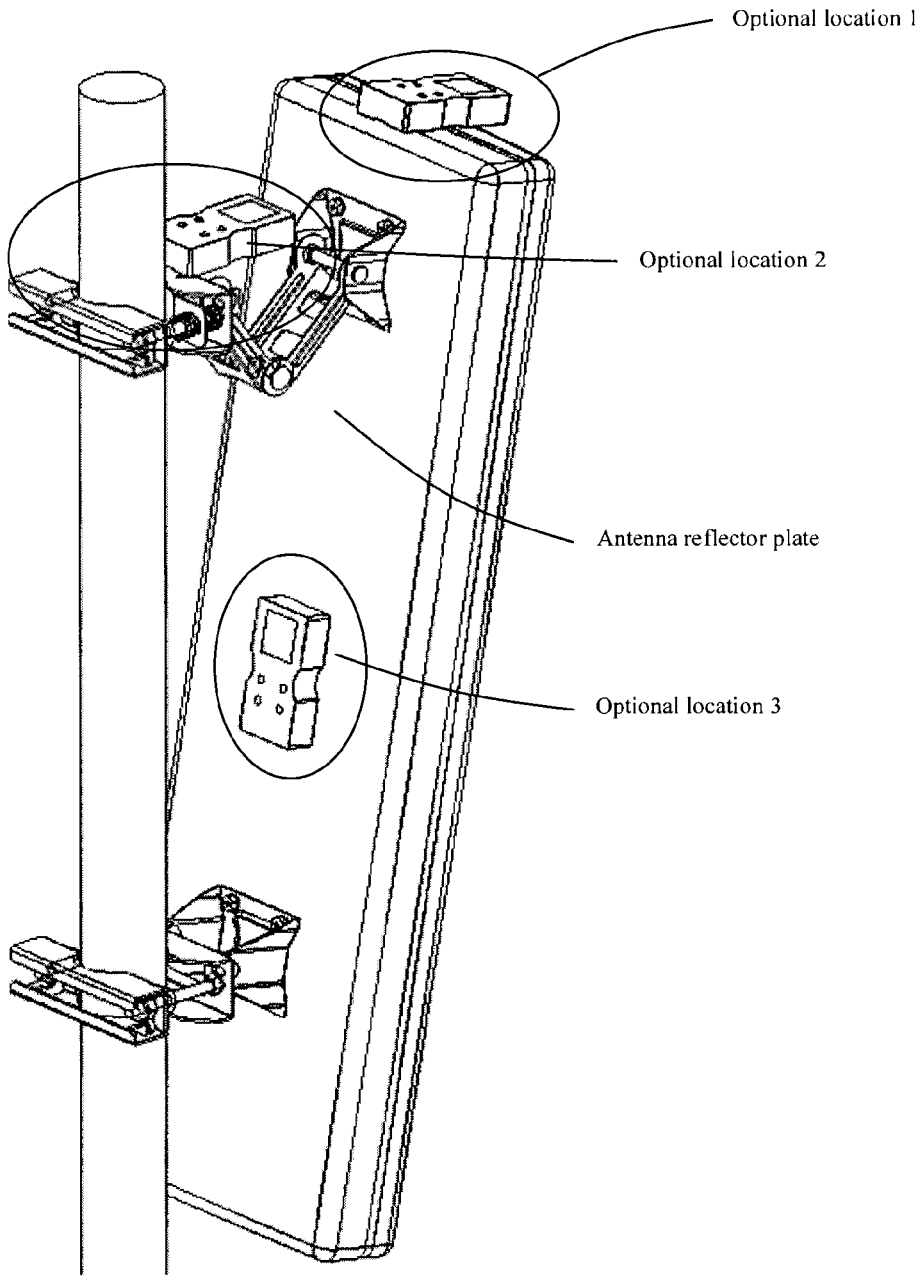
FIG. 13 is a schematic location diagram of an auxiliary device for adjusting an antenna angle according to an embodiment of the present invention.

As shown in FIG. 13, FIG. 14, and FIG. 15, if the antenna is a base station antenna, there are three optional locations for loacting the auxiliary device in the following:

Optional Location 1:

The auxiliary device is set on the upper side of the base station antenna, and the bottom plane of the auxiliary device is perpendicular to a reflector plate of the base station antenna, so as to ensure that the horizontal azimuth measured by the auxiliary device is the horizontal azimuth of the antenna and the tilt angle measured by the auxiliary device is the tilt angle of the antenna.

Optional Location 2:

The auxiliary device is set on the mount kit. When the antenna is vertical, namely, the tilt angle of the antenna is zero degree, the bottom plane of the auxiliary device is perpendicular to the reflector plate of the antenna, so as to ensure that the horizontal azimuth measured by the auxiliary device is the horizontal azimuth of the antenna. At this location, the auxiliary device can measure only the horizontal azimuth of the antenna rather than the tilt angle of the antenna.

Optional Location 3:

The auxiliary device is set at the back of the antenna. The bottom plane of the auxiliary device is parallel to the surface of the reflector plate of the antenna, and the central axis plane of the auxiliary device is also parallel to the central axis plane of the reflector plate of the antenna, so as to ensure that the horizontal azimuth measured by the auxiliary device is the horizontal azimuth of the antenna and the tilt angle measured by the auxiliary device is the tilt angle of the antenna.

Figure 16:
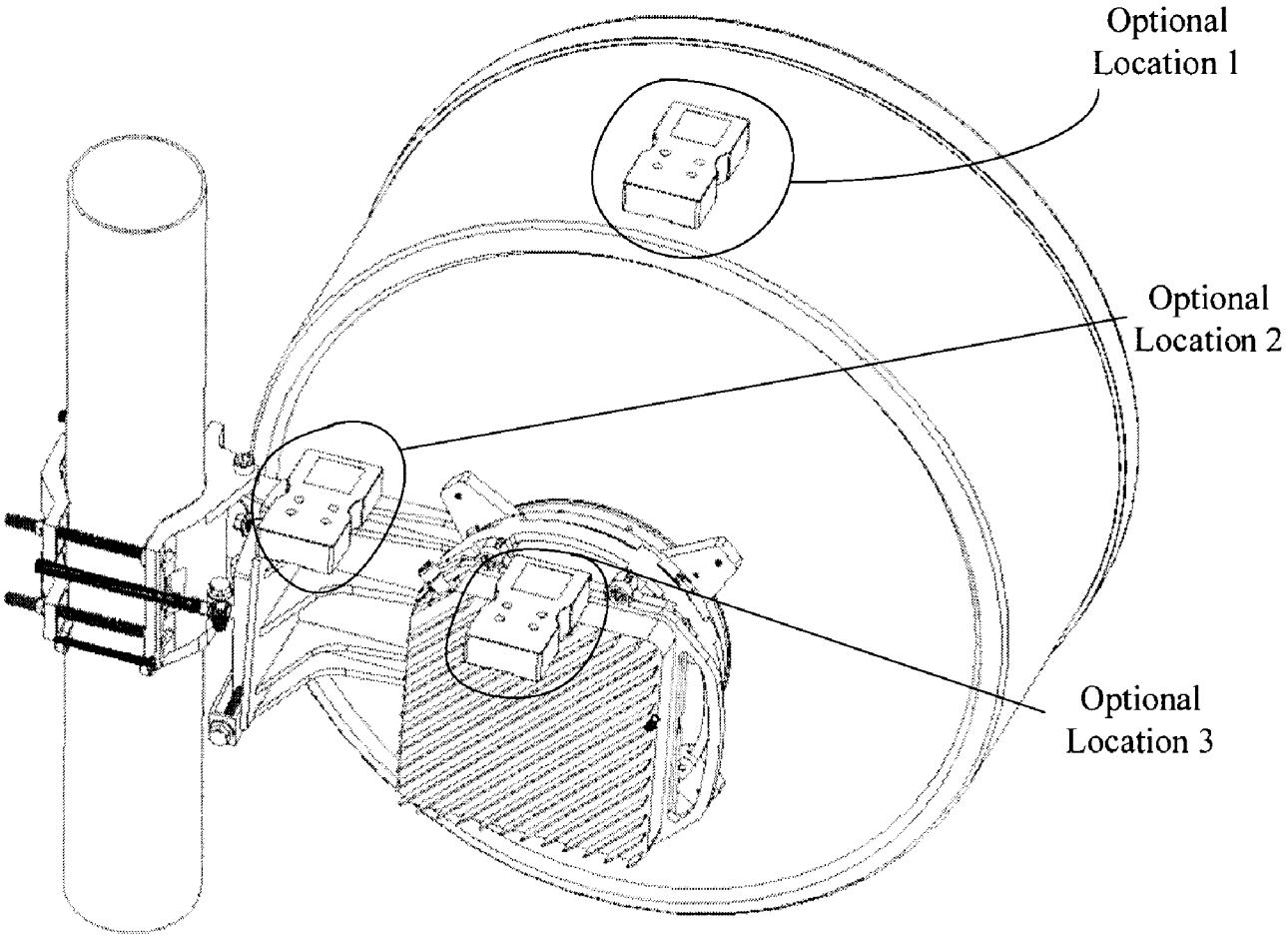
FIG. 16 is a schematic location diagram of an auxiliary device for adjusting an antenna angle according to an embodiment of the present invention.

As shown in FIG. 16, if an antenna is a microwave antenna, there are three optional locations for loacting the auxiliary device in the following:

Optional Location 1:

The auxiliary device is set on the microwave antenna. The bottom plane of the auxiliary device is parallel to the major lobe axis of the microwave antenna, and the central axis plane of the auxiliary device is also parallel to the major lobe axis of the microwave antenna, so as to ensure that the horizontal azimuth measured by the auxiliary device is the horizontal azimuth of the microwave antenna and the tilt angle measured by the auxiliary device is the tilt angle of the antenna.

Optional Location 2:

The auxiliary device is set on the mount kit. The bottom plane of the auxiliary device is parallel to the major lobe axis of the microwave antenna, and the central axis plane of the auxiliary device is also parallel to the major lobe axis of the microwave antenna, so as to ensure that the horizontal azimuth measured by the auxiliary device is the horizontal azimuth of the microwave antenna and the tilt angle measured by the auxiliary device is the tilt angle of the antenna.

Optional Location 3:

The auxiliary device is set on the casing of an ODU (Outdoor unit, outdoor unit), and the ODU is set on the microwave antenna. The bottom plane of the auxiliary device is parallel to the major lobe axis of the microwave antenna, and the central axis plane of the auxiliary device is also parallel to the major lobe axis of the microwave antenna, so as to ensure that the horizontal azimuth measured by the auxiliary device is the horizontal azimuth of the microwave antenna and the tilt angle measured by the auxiliary device is the tilt angle of the antenna.

In the embodiments of the present invention, the auxiliary device may be not only set outside the antenna, but also integrated inside the antenna. However, if the auxiliary device is set inside the antenna, it is required to ensure that the horizontal azimuth measured by the auxiliary device is the horizontal azimuth of the microwave antenna and the tilt angle measured by the auxiliary device is the tilt angle of the antenna.

Figure 17:
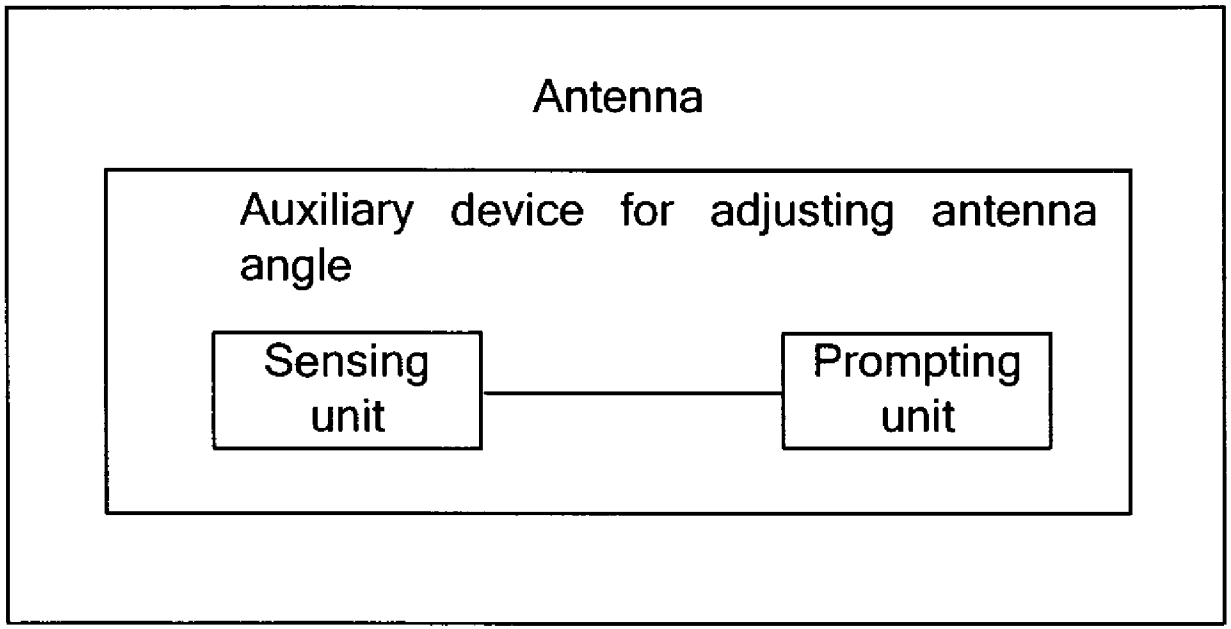
FIG. 17 is a schematic diagram of an antenna system according to an embodiment of the present invention.

As shown in FIG. 17, in some embodiments, the present invention provides an antenna system. The antenna system includes an antenna and an auxiliary device that is set in the antenna and is for adjusting an antenna angle. The auxiliary device for adjusting an antenna angle includes:

a sensing unit, configured to perform sensing and obtain angle information of the antenna; and a prompt unit, configured to send a prompt when the angle information of the antenna is consistent with preset angle information of the antenna.

In one embodiment of the present invention, the angle information of the antenna sensed by the sensing unit of the auxiliary device is consistent with the angle of the antenna. The angle information of the antenna sensed by the sensing unit may reflect the current angle of the antenna. While an overhead worker on a tower adjusts the antenna, the prompting unit may send prompting information when the angle of the antenna is consistent with the preset angle information of the antenna, where the prompting information indicates that the antenna is adjusted into suitable position. The overhead worker stops operations upon receiving the prompting information, thereby effectively improving the efficiency of adjusting the antenna angle.

Further, the auxiliary device for adjusting an antenna angle may also include: a processing unit, configured to compare the angle information of the antenna with the preset angle information of the antenna according to the angle information of the antenna and the preset angle information of the antenna, and control the prompt unit to send a prompt when the angle information of the antenna is consistent with the preset angle information of the antenna.

Further, the auxiliary device for adjusting an antenna angle may also include:

an inputting unit, configured to input the preset angle information of the antenna.

For the specific implementation of the inputting unit, processing unit, prompt unit, and sensing unit, reference can be made to the embodiments described above (for the prompt unit, reference can be made to the embodiment of the prompting unit).

In the embodiment of the present invention, the antenna may be a microwave antenna or a base station antenna.

Figure 18:
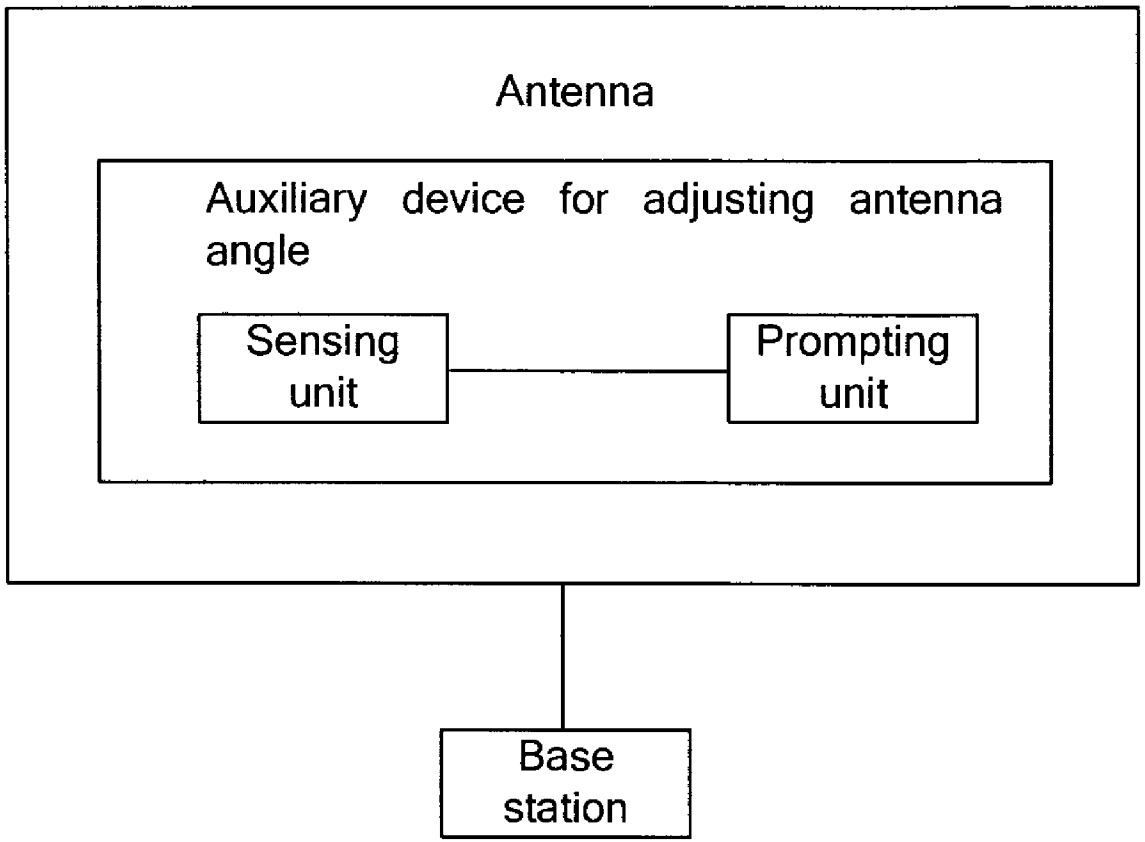
FIG. 18 is a schematic diagram of a base station system according to an embodiment of the present invention.

As shown in FIG. 18, in some embodiments, the present invention further provides a base station system. The base station system includes a base station, an antenna, and an auxiliary device for adjusting an antenna angle. The auxiliary device for adjusting an antenna angle includes:

a sensing unit, configured to perform sensing and obtain angle information of the antenna; and a prompt unit, configured to send a prompt when the angle information of the antenna is consistent with preset angle information of the antenna.

The sensing unit and the prompt unit of the auxiliary device for adjusting an antenna angle are set in the antenna.

In one embodiment of the present invention, the angle information of the antenna sensed by the sensing unit of the auxiliary device is consistent with the angle of the antenna. The angle information of the antenna sensed by the sensing unit may reflect the current angle of the antenna. While an overhead worker on a tower adjusts the antenna, the prompting unit sends prompting information when the angle of the antenna is consistent with the preset angle information of the antenna, where the prompting information indicates that the antenna is adjusted into position. The overhead worker stops operations upon receiving the prompting information, thereby effectively improving the efficiency of adjusting the antenna angle.

Further, the auxiliary device for adjusting an antenna angle may also include: a processing unit, configured to compare the angle information of the antenna with the preset angle information of the antenna according to the angle information of the antenna and the preset angle information of the antenna, and control the prompting unit to send a prompt when the angle information of the antenna is consistent with the preset angle information of the antenna. The processing unit of the auxiliary device for adjusting an antenna angle is set in the base station.

Further, the auxiliary device for adjusting an antenna angle may also include:

an inputting unit, configured to input the preset angle information of the antenna.

The inputting unit of the auxiliary device for adjusting an antenna angle is set in the base station.

For the specific implementation of the inputting unit, processing unit, prompt unit, and sensing unit, reference can be made to the embodiments described above (for the prompt unit, reference can be made to the embodiment of the prompting unit).

In the embodiment of the present invention, the antenna may be a microwave antenna or a base station antenna.

Persons of ordinary skill in the art understand that all or part of the steps of the method provided in the embodiments above may be implemented by a computer program instructing relevant hardware. The program may be stored in a computer readable storage medium. When the program runs, the program executes the steps of the method specified in any embodiment above. The storage medium may be a magnetic disk, a CD-ROM, a read-only memory (Read-Only Memory, ROM), or a random access memory (Random Access Memory, RAM).

The above description is merely some embodiments of the present invention. Those skilled in the art can make various modifications or variations based on the disclosed content of the application without departing from the spirit and the scope of the present invention.

What is claimed is:

1. A method for adjusting an antenna angle, comprising:

obtaining angle information of an antenna; and comparing the obtained angle information of the antenna with preset angle information of the antenna, and emitting a prompt perceptible to a user when the obtained angle information of the antenna is consistent with the preset angle information of the antenna.

2. The method for adjusting an antenna angle according to claim 1, wherein:

the preset angle information of the antenna comprises a horizontal azimuth of the antenna, or a tilt angle of the antenna, or both the horizontal azimuth of the antenna and the tilt angle of the antenna.

3. The method for adjusting an antenna angle according to claim 1, wherein:

the obtained angle information of the antenna comprises a horizontal azimuth of the antenna, or a tilt angle of the antenna, or both the horizontal azimuth of the antenna and the tilt angle of the antenna.

4. The method for adjusting an antenna angle according to claim 1, wherein:

the prompt includes a sound signal, or a vibration signal, or a light signal, or any combination of a sound signal, a vibration signal, and a light signal.

5. An auxiliary device for adjusting an antenna angle, comprising:

an inputting unit, configured to input preset angle information of an antenna;

a sensing unit, configured to obtain angle information of the antenna;

a processing unit, configured to compare the obtained angle information of the antenna with the preset angle information of the antenna, and control a prompting unit to emit a prompt perceptible to a user when the obtained angle information of the antenna is consistent with the preset angle information of the antenna; and the prompting unit, configured to send the prompt.

6. The auxiliary device for adjusting an antenna angle according to claim 5, wherein:

the preset angle information of the antenna comprises a horizontal azimuth of the antenna, or a tilt angle of the antenna, or both the horizontal azimuth of the antenna and the tilt angle of the antenna.

7. The auxiliary device for adjusting an antenna angle according to claim 5, wherein:

the obtained angle information of the antenna comprises a horizontal azimuth of the antenna, or a tilt angle of the antenna, or both the horizontal azimuth of the antenna and the tilt angle of the antenna.

8. The auxiliary device for adjusting an antenna angle according to claim 5, wherein:

the prompt sent by the prompting unit includes a sound signal, or a vibration signal, or a light signal, or any combination of a sound signal, or a vibration signal, or a light signal.

9. The auxiliary device for adjusting an antenna angle according to claim 5, wherein:

the sensing unit comprises a north-seeking gyro, or a total station, or a dual-GPS, or a magnetic flux sensor, or a gravity sensor.

10. The auxiliary device for adjusting an antenna angle according to claim 5, wherein:

the sensing unit comprises a magnetic flux sensor and a gravity sensor.

11. The auxiliary device for adjusting an antenna angle according to claim 5, wherein:

the auxiliary device for adjusting an antenna angle further comprises a filtering and amplifying circuit configured to filter and amplify the obtained angle information of the antenna for being processed by a subsequent circuit.

12. The auxiliary device for adjusting an antenna angle according to claim 5, wherein:

the auxiliary device for adjusting an antenna angle further comprises an analogy-to-digital sampling circuit, which is configured to perform analog-digital conversion for the obtained angle information of the antenna.

13. The auxiliary device for adjusting an antenna angle according to claim 5, wherein:

the processing unit comprises a Micro Control Unit (MCU) processing circuit, which is configured to compare the obtained angle information of the antenna and the preset angle information of the antenna, and control the prompting unit to send to prompt when the angle information of the antenna is consistent with the preset angle information of the antenna.

14. The auxiliary device for adjusting an antenna angle according to claim 13, wherein the MCU processing circuit comprises a signal receiving unit, a calculating unit, and a controlling unit, wherein:

the signal receiving unit is configured to receive the angle information of the antenna and the preset angle information of the antenna, and perform digital filtering for the angle information of the antenna and the preset angle information of the antenna;

the calculating unit is configured to calculate a difference between the preset angle information of the antenna and the angle information of the antenna, wherein the angle deviation signal indicates whether the angle information of the antenna is consistent with the preset angle information of the antenna; and the controlling unit is configured to control the prompting unit to send the prompt when the angle deviation signal indicates that the angle information of the antenna is consistent with the preset angle information of the antenna.

15. The auxiliary device for adjusting an antenna angle according to claim 5, wherein:

the inputting unit includes a keypad.

16. An antenna system comprising:

an auxiliary device for adjusting an antenna angle;

an antenna;

a mount kit for mounting the antenna;

wherein, the auxiliary device is configured to adjust the antenna and comprises:

an inputting unit, configured to input preset angle information of an antenna;

a sensing unit, configured to obtain angle information of the antenna;

a processing unit, configured to compare the obtained angle information of the antenna with the preset angle information of the antenna, and control a prompting unit to emit a prompt perceptible to a user when the obtained angle information of the antenna is consistent with the preset angle information of the antenna; and the prompting unit, configured to send the prompt; and a casing, wherein an outer surface of the casing is a bottom plane of the auxiliary device for adjusting an antenna angle.

17. The antenna system according to claim 16, wherein:

the antenna is a base station antenna, the auxiliary device for adjusting an antenna angle is set on an upper side of the base station antenna, and the bottom plane of the auxiliary device for adjusting an antenna angle is perpendicular to a reflector plate of the base station antenna.

18. The antenna system according to claim 16, wherein:

the antenna is a base station antenna, the auxiliary device for adjusting an antenna angle is set on the mount kit, and when a tilt angle of the antenna is zero degree, the bottom plane of the auxiliary device for adjusting an antenna angle is perpendicular to a reflector plate of the antenna.

19. The antenna system according to claim 16, wherein:

the antenna is a base station antenna, the auxiliary device for adjusting an antenna angle is set at the back of the antenna, and the bottom plane of the auxiliary device for adjusting an antenna angle is parallel to a surface of a reflector plate of the antenna; and a central axis plane of the auxiliary device for adjusting an antenna angle is parallel to a central axis plane of the reflector plate of the antenna.

20. The antenna system according to claim 16, wherein:

the antenna is a microwave antenna, the auxiliary device is set on the microwave antenna, and the bottom plane of the auxiliary device for adjusting an antenna angle is parallel to a major lobe axis of the microwave antenna; and a central axis plane of the auxiliary device for adjusting an antenna angle is parallel to the major lobe axis of the microwave antenna.

21. The antenna system according to claim 16, wherein:

the antenna is a microwave antenna, the auxiliary device for adjusting an antenna angle is set on the mount kit, and the bottom plane of the auxiliary device for adjusting an antenna angle is parallel to a major lobe axis of the microwave antenna; and a central axis plane of the auxiliary device for adjusting an antenna angle is parallel to the major lobe axis of the microwave antenna.

22. The antenna system according to claim 16, wherein:

the antenna is a microwave antenna, the auxiliary device for adjusting an antenna angle is set on a casing of an outdoor unit, wherein the outdoor unit is set on the microwave antenna, and the bottom plane of the auxiliary device for adjusting an antenna angle is parallel to a major lobe axis of the microwave antenna; and a central axis plane of the auxiliary device for adjusting an antenna angle is parallel to the major lobe axis of the microwave antenna.

23. An antenna system, comprising:

an antenna; and an auxiliary device set in the antenna for adjusting an antenna angle, wherein the auxiliary device for adjusting an antenna angle comprises:

a sensing unit, configured to obtain angle information of the antenna; and a prompt unit, configured to emit a prompt perceptible to a user when the obtained angle information of the antenna is consistent with preset angle information of the antenna.

24. The antenna system according to claim 23, wherein the auxiliary device for adjusting an antenna angle further comprises:

a processing unit, configured to compare the obtained angle information of the antenna with the preset angle information of the antenna, and control the prompt unit to send the prompt when the angle information of the antenna is consistent with the preset angle information of the antenna.

25. The antenna system according to claim 23, wherein the auxiliary device for adjusting an antenna angle further comprises:

an inputting unit, configured to input the preset angle information of the antenna.

26. The antenna system according to claim 23, wherein:

the antenna is a microwave antenna or a base station antenna.

27. A base station system, comprising:

a base station, an antenna, and an auxiliary device for adjusting an antenna angle, comprising:

a sensing unit, configured to obtain angle information of the antenna; and a prompt unit, configured to send a prompt perceptible to a user when the obtained angle information of the antenna is consistent with preset angle information of the antenna;

wherein the sensing unit and the prompt unit of the auxiliary device for adjusting an antenna angle are set in the antenna.

28. The base station system according to claim 27, wherein:

the auxiliary device for adjusting an antenna angle further comprises: a processing unit, configured to compare the angle information of the antenna with the preset angle information of the antenna according to the angle information of the antenna and the preset angle information of the antenna, and control the prompt unit to send the prompt when the angle information of the antenna is consistent with the preset angle information of the antenna; and the processing unit of the auxiliary device for adjusting an antenna angle is set in the base station.

29. The base station system according to claim 27, wherein:

the auxiliary device for adjusting an antenna angle further comprises an inputting unit configured to input the preset angle information of the antenna; and the inputting unit of the auxiliary device for adjusting an antenna angle is set in the base station.

* * * * *

UNITED STATES PATENT AND TRADEMARK OFFICE

CERTIFICATE OF CORRECTION

PATENT NO. : 8,362,964 B2
APPLICATION NO. : 13/463957
DATED : January 29, 2013
INVENTOR(S) : Youhe Ke et al.

It is certified that error appears in the above-identified patent and that said Letters Patent is hereby corrected as shown below:

In the Claims:

In claim 13, column 12, line 38, "unit to send to prompt" should read -- unit to send a prompt --.

Signed and Sealed this
Seventh Day of May, 2013

Teresa Stanek Rea
*Acting Director of the United States Patent and Trademark Office*